US006698908B2

(12) United States Patent
Sitzema, Jr. et al.

(10) Patent No.: US 6,698,908 B2
(45) Date of Patent: Mar. 2, 2004

(54) LIGHTING FIXTURE OPTICAL ASSEMBLY INCLUDING RELECTOR/REFRACTOR AND COLLAR FOR ENHANCED DIRECTIONAL ILLUMINATION CONTROL

(75) Inventors: Ronald L. Sitzema, Jr., Ellsworth, MI (US); Gwen Barber, Roseville, CA (US)

(73) Assignee: Lexalite International Corporation, Charlevoix, MI (US)

( * ) Notice: Subject to any disclaimer, the term of this patent is extended or adjusted under 35 U.S.C. 154(b) by 0 days.

(21) Appl. No.: 10/113,176

(22) Filed: Mar. 29, 2002

(65) Prior Publication Data

US 2003/0185012 A1 Oct. 2, 2003

(51) Int. Cl.[7] ..... F21V 5/00

(52) U.S. Cl. ..... 362/328; 362/299; 362/340; 362/343; 362/346; 362/350; 362/437; 362/255; 362/297; 362/327; 362/443

(58) Field of Search ..... 362/328, 327, 362/255, 257, 296, 297, 341, 443, 350, 340

(56) References Cited

U.S. PATENT DOCUMENTS

| | | | | |
|---|---|---|---|---|
| 1,286,535 A | | 12/1918 | Cochran | |
| 3,705,303 A | * | 12/1972 | Willis, Jr. et al. | 362/308 |
| 4,173,037 A | | 10/1979 | Henderson, Jr. et al. | |
| 4,231,080 A | | 10/1980 | Compton | |
| 4,404,620 A | * | 9/1983 | Takahashi et al. | 362/304 |
| 4,839,781 A | | 6/1989 | Barnes et al. | |
| 4,943,901 A | | 7/1990 | Baldwin et al. | |
| 5,178,452 A | | 1/1993 | Scholz | |
| 5,251,116 A | | 10/1993 | Wijbenga et al. | |
| 5,444,606 A | | 8/1995 | Barnes et al. | |
| 5,481,445 A | | 1/1996 | Sitzema et al. | |
| 5,582,479 A | | 12/1996 | Thomas et al. | |
| 5,791,768 A | | 8/1998 | Splane, Jr. | |
| 6,068,388 A | | 5/2000 | Walker et al. | |
| 6,086,227 A | * | 7/2000 | O'Connell et al. | 362/297 |
| 6,273,590 B1 | | 8/2001 | Splane, Jr. | |

OTHER PUBLICATIONS

Stingray Dual Reflector Lighting System, The Next Generation High Bay brochure, 4 pages, undated.

* cited by examiner

*Primary Examiner*—Stephen Husar
*Assistant Examiner*—Sharon Payne
(74) *Attorney, Agent, or Firm*—Joan Pennington

(57) ABSTRACT

An improved optical assembly includes a reflector/refractor device and a reflector collar provided for enhanced directional illumination control. The reflector/refractor has a predefined shape and has a plurality of reflector/refractor prisms on an exterior body surface for reflecting and refracting light. A light source is disposed within the reflector/refractor substantially along a central vertical axis of the reflector/refractor. The reflector collar supports the reflector/refractor and attaches the reflector/refractor to a luminaire ballast. The reflector collar has a predetermined contour and a plurality of reflector impressions formed into the predetermined contour. The predetermined contour and the plurality of reflector impressions provide directional illumination control for the optical assembly.

19 Claims, 13 Drawing Sheets

PRIOR ART

LIGHTING FIXTURE OPTICAL ASSEMBLY INCLUDING RELECTOR/REFRACTOR AND COLLAR FOR ENHANCED DIRECTIONAL ILLUMINATION CONTROL

FIELD OF THE INVENTION

The present invention relates to lighting fixtures and luminaires, and more particularly to an improved optical assembly including a reflector/refractor device and a reflector collar for enhanced directional illumination control.

DESCRIPTION OF THE RELATED ART

Various arrangements are known for reflectors when used as lighting fixtures and luminaires. Some known reflectors are manufactured in metals such as aluminum and steel, or of a glass or plastic. These materials are then painted, plated, or chemically brightened to function as reflectors. Vacuum metallizing, vapor or chemical deposition can be used to place a thin metal layer onto the surface of the metal, plastic or glass to act as reflector. There are also prismatic internal reflection glass and plastic reflectors which use the index of refraction to control the reflectance of light and redirect it into a distribution of light. Some glass reflectors are known to use a metal cover spun around the exterior to eliminate uplight, radiated by the large rounded portion of their prism peaks and roots, and the cover is used as a means of glare control and to maintain a clean exterior internal reflection surface. However, this creates a very dark reflector exterior and a very bright aperture brightness, and when installed in a room this reflector produces very reduced uplight with no means of adjusting the glass reflectors' reflected surface brightness to any other ambient lighting concerns or conditions.

Improvements over prior art arrangements have been provided by prismatic reflector/refractor, such as disclosed in the following United States patents.

U.S. Pat. No. 4,839,781 issued to Josh T. Barnes and Ronald J. Sitzema Jun. 13, 1989 and assigned to the present assignee, discloses a reflector/refractor device for use with a variety of lighting fixtures and light sources. The reflector/refractor device includes a body having a predetermined profile and defining a cavity with the body having an inside surface and an outside surface. An illuminating source for emitting light is disposed within the cavity substantially along a central vertical axis of the body. The body includes a series of sectional zones for reflecting and refracting light. The exterior surface of the device includes a plurality of substantially vertical prisms consisting of reflective elements, refractive elements and elements that may be either reflective or refractive depending on light center location. These reflective or refractive elements act in combination to selectively vary light distribution characteristics of vertical and lateral angles, and intensities, by vertical displacement of the illuminating lamp source.

U.S. Pat. No. 5,444,606 issued to Josh T. Barnes and Paul C. Belding Aug. 22, 1995 and assigned to the present assignee, discloses a combination of a prismatic reflector and a prismatic lens is provided for use with lighting fixtures. A reflector body has a substantially parabolic contour defining an interior cavity. The reflector body includes a plurality of prisms for receiving, transmitting and reflecting light. A lens body has a first mating surface engaging the reflector body, an opposed inverted conical surface, and a sloping sidewall extending between the mating surface and the opposed inverted conical surface. The mating surface of the lens body has a larger diameter than the opposed inverted conical surface. The opposed inverted conical surface includes a plurality of prisms for receiving and for redirecting light.

Prior art of collar attachment to polymeric prismatic reflectors has been generally limited to using a stamped aluminum rings as a simple retention device, and generally as a means of reflecting extraneous light away from the Nadir position of a photometric distribution. These designs concentrated on producing batwing distributions.

The original reflector collar designs were intended to produce only batwing distributions with spacing criteria of 1.6:1 to 2.0:1. While the original designs of the collar and polymeric reflector provided excellent overall efficiency and coefficient of utilization for room cavity designs, it meant that batwing distributions would often need to be spaced closer than their intended spacing to meet required footcandle levels and watt per square foot energy consumption legislation. A need for narrower spacing with higher footcandle levels below the luminaire was needed to reduce the number of luminaires consuming energy in the lighted space. This also meant increasing or achieving horizontal footcandle requirements at the floor and maintaining vertical footcandle levels on shelving or racks of warehouses and interior lighting of commercial stores. In essence this is a shift in design practice which was to cover large areas of open space with uniform illumination, to a concept of concentrating illumination and energy use in narrower patterns for specific lighting requirements and tasks.

A need exists for effective mechanism for providing enhanced directional illumination control for an improved optical assembly. It is desirable to provide such an improved optical assembly for concentrating illumination and energy use in narrower patterns for specific lighting requirements and tasks.

SUMMARY OF THE INVENTION

A principal object of the present invention is to provide an improved optical assembly including a reflector/refractor device and a collar for enhanced directional illumination control. Other important objects of the present invention are to provide such an improved optical assembly including a reflector/refractor device and a collar for enhanced directional illumination control substantially without negative effect; and that overcome many of the disadvantages of prior art arrangements.

In brief, an improved optical assembly including a reflector/refractor device and a reflector collar provided for enhanced directional illumination control. The reflector/refractor has a predefined shape and has a plurality of reflector/refractor prisms on an exterior body surface for reflecting and refracting light. A light source is disposed within the reflector/refractor substantially along a central vertical axis of the reflector/refractor. The reflector collar supports the reflector/refractor and attaches the reflector/refractor to a luminaire ballast. The reflector collar has a predetermined contour and a plurality of reflector impressions formed into the predetermined contour. The predetermined contour and the plurality of reflector impressions provide directional illumination control for the optical assembly.

BRIEF DESCRIPTION OF THE DRAWINGS

The present invention together with the above and other objects and advantages may best be understood from the following detailed description of the preferred embodiments of the invention illustrated in the drawings, wherein:

FIGS. 7BB, 8BB and 9BB respectively illustrate light ray traces of an enlarged portion of the reflector collar in accordance with the preferred embodiment from the top, middle and bottom of a light source.

DETAILED DESCRIPTION OF THE PREFERRED EMBODIMENTS

In accordance with the invention, an improved optical assembly is provided by a clear prismatic reflector/refractor having its exterior surface substantially covered with multiple internal reflecting prisms in combination with a reflector collar of the preferred embodiment that is arranged to provide additional optical control. The reflector collar of the preferred embodiment is used for the attachment of a polymeric prismatic reflector/refractor to a luminaire ballast capsule and provides a means of narrowing the photometric distribution of the polymeric prismatic reflector/refractor. The narrowing of the distribution causes an increase to the efficiency in the 0–40 degree zonal lumens while maintaining the overall efficiency of the polymeric prismatic reflector through the use of the reflector collar predetermined contour and multiple small concave reflector impressions that are formed into the reflector collar.

Figure 1A:
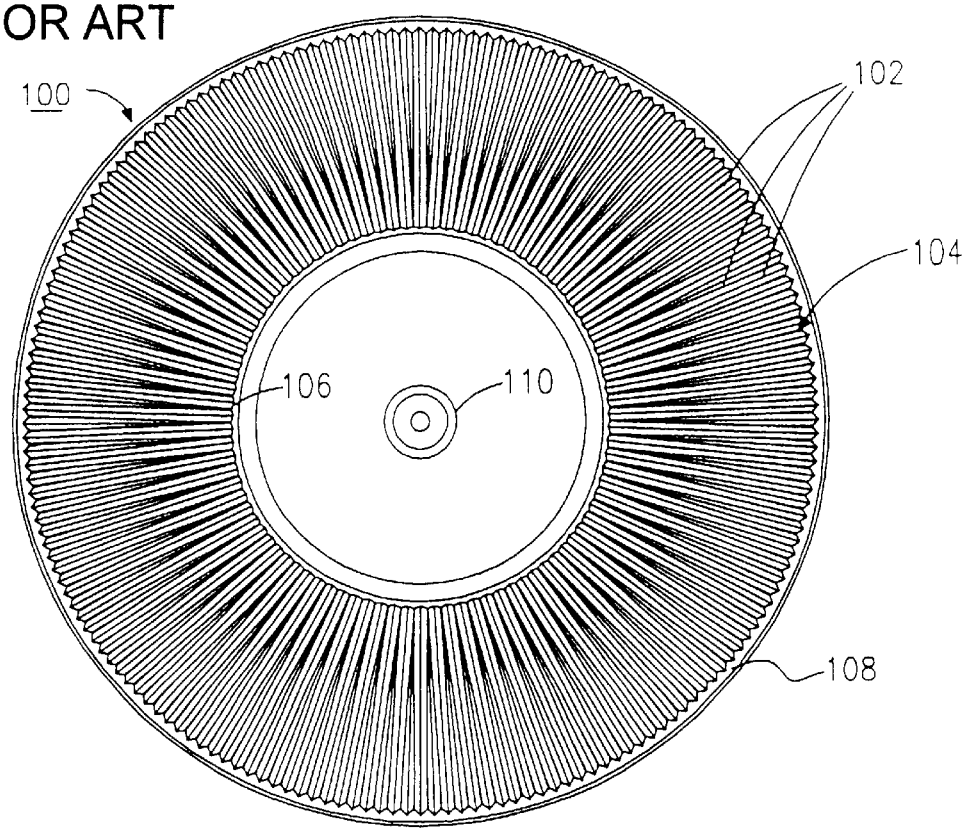
FIG. 1A PRIOR ART
FIGS. 1A and 1B are top and side elevational views illustrating a prismatic reflector/refractor device in accordance with the preferred embodiment.
Figure 1B:
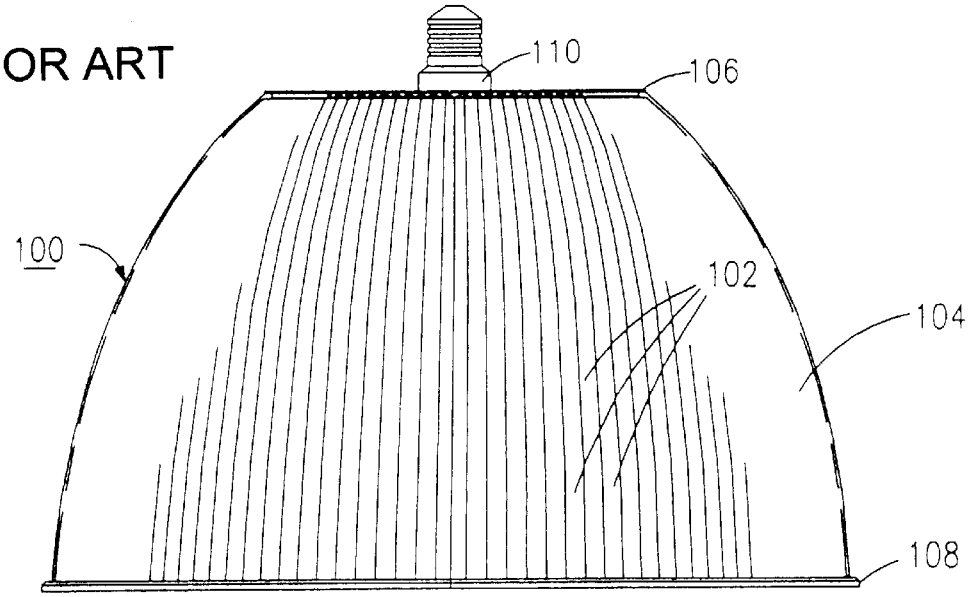

Having reference now to the drawings, in FIGS. 1A and 1B, there is shown a prismatic reflector/refractor device generally designated as 100 in accordance with the preferred embodiment. The prismatic reflector/refractor 100 is formed of a substantially transparent light transmitting material, such as an acrylic or similar material.

Prismatic reflector/refractor 100 is specifically designed to provide a certain amount of additional light through its sidewall for adding additional illumination to the surround, increasing the uniformity in the surround, and for spreading the lamp image over a large area to reduce glare from a light source or lamp 110.

The reflector/refractor 100 of the preferred embodiment has a plurality of vertical prisms 102 on an outside or exterior surface 104 extending between an upper flange, opening 106 and a lower flange, opening 108. The prismatic reflector/refractor 100 advantageously is the type described in the above-identified U.S. Pat. Nos. 5,444,606 and 4,839,781. The subject matter of each of the above-identified U.S. Pat. Nos. 5,444,606 and 4,839,781 is incorporated herein by reference.

In accordance with features of the invention, a reflector collar 200 for enhanced directional illumination control of the preferred embodiment and reflector/refractor 100 are provided in combination to construct an optical assembly 202 of the preferred embodiment as illustrated in FIGS. 2–6 and FIGS. 7B, 8B and 9B. Reflector collar 200 is used for the attachment of a polymeric prismatic reflector/refractor 100 to a luminaire ballast capsule (not shown). The reflector collar 200 narrows the photometric distribution of the reflector/refractor 100 through the use of its shape and multiple small concave reflector impressions 220 that are embossed into the reflector collar 200. Each of the multiple concave reflector impressions 220 is formed as a segment of a sphere at a predetermined depth and a prescribed spread of diffusion from the lamp source 110.

In accordance with features of the invention, the reflector collar profile 210 includes the generally concave reflector impressions 220 facing the lamp center arranged at predetermined locations and at a predetermined density to create a controlled spreading of the reflected light away from the lamp 110 and the sidewall of the polymeric reflector/refractor 100. The spreading of the reflected light from the reflector collar 200 is distributed to project the majority of the rays through the bottom opening 108 of the polymeric reflector/refractor 100, thus increasing the intensity of the distribution and narrowing the distribution of the polymeric reflector.

Referring to FIGS. 2, 3, 4, 5, and 6, the polymeric prismatic reflector/refractor 100 rests on a lower portion 204 of the reflector collar 200 and held in position by a plurality of bendable tabs 206 cut from the reflector/collar contour and bent over an upper neck opening defined by flange 106 of the polymeric prismatic reflector/refractor 100 during assembly of the optical assembly 202. Reflector collar 200 has a predetermined contour generally designated by the reference character 210 and is arranged for forming an extension of the interior contour of the polymeric prismatic reflector/refractor 100. The reflector collar shape 210 is matched generally as continuation of the interior contour of the polymeric reflector/refractor 100 progressing from a lower edge 212 having a larger diameter than the top flange opening 106 of the polymeric reflector/refractor 100 and the predetermined shape 210 continues to a central opening 214 in the of the reflector collar 200 for receiving the lamp 110. The reflector collar 200 supports the polymeric prismatic reflector 110 with the lower reflector collar edge 212 positioned approximately 1 inch or 2.56 cm. below the upper flange 106 of the polymeric prismatic reflector 110. The down-light reflector collar 200 includes features 216 and a series of different patterns 218 cut into the collar for attachment to one of various commercially available ballasts or luminaire ballast capsules.

The down-light reflector collar 200 of the preferred embodiment is made from a highly reflective aluminum and preferably is bright dipped and anodized to maintain the high reflectance of the metal. When assembled in optical assembly 202, the reflector collar 200 effectively narrows the overall distribution of the polymeric prismatic reflector/refractor 100, increasing the 0–40 degree zonal efficiency of the photometric distribution while maintaining the overall efficiency of the polymeric prismatic reflector. The increase in efficiency of the 0–40 degree area will cause some reduction in the uplight values of the 90°–180° zonal efficiency. However, this reduction is controlled by the size of down-light reflector collar 200 and not intended to eliminate all of the uplight. The result leaves substantial illumination available for the use of this uplight illumination in areas where it may be advantagous to provide some uplight. This is especially important in high ceiling mounting heights to reduce some of the ceiling brightness while at the same time not creating a dark cavern effect ceiling in the room or lighting installation.

Figure 2:
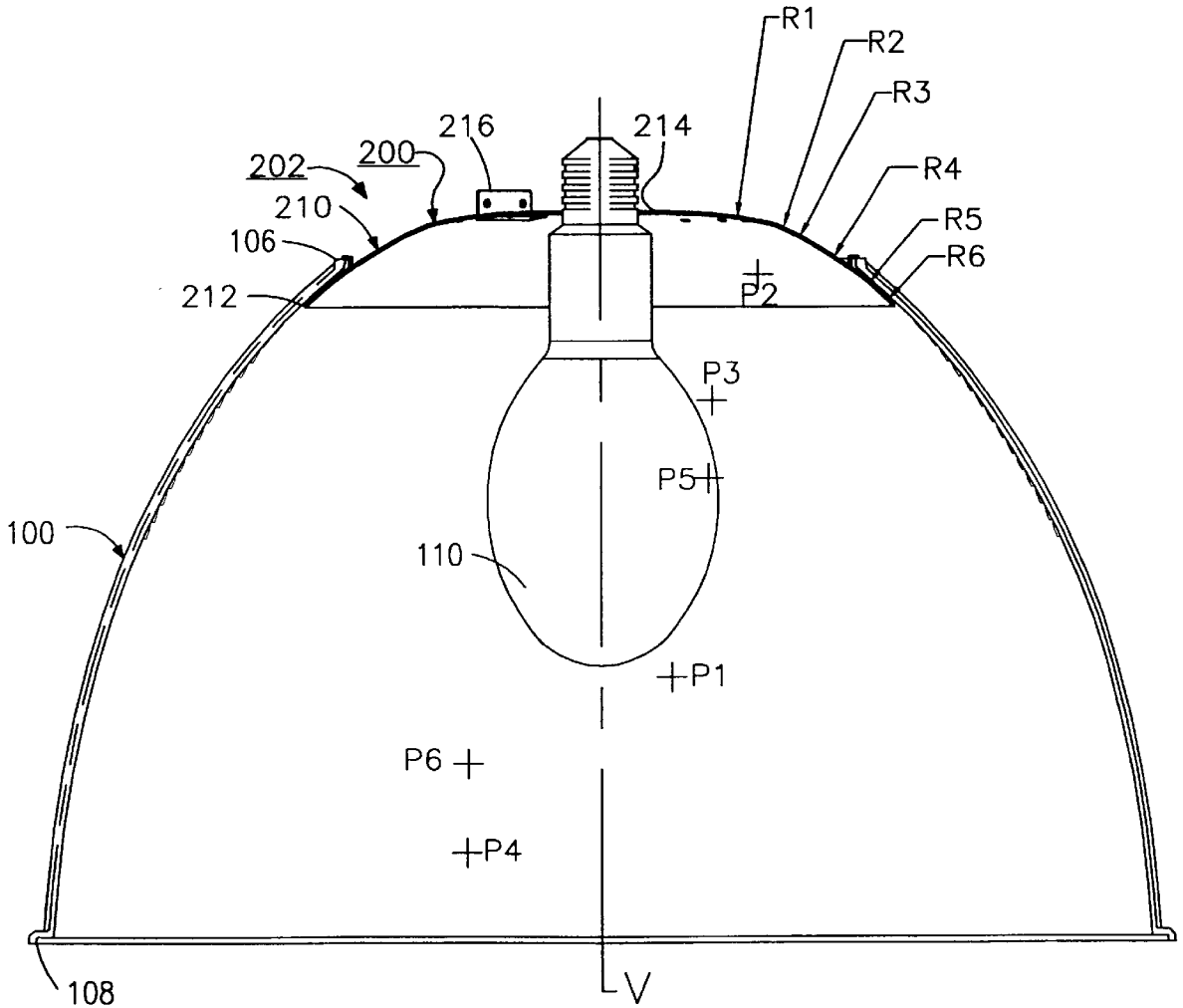
FIG. 2 is a partially broken away view of an optical assembly including the prismatic reflector/refractor device of FIGS. 1A and 1B together with a collar for enhanced directional illumination control in accordance with the preferred embodiment.
Figure 5:
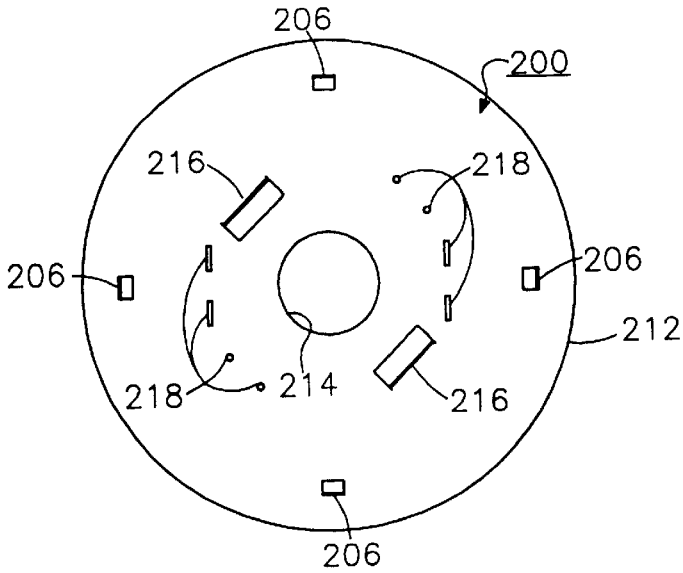
FIG. 5 is a top elevational view of the collar of FIG. 2 in accordance with the preferred embodiment.
Figure 4:
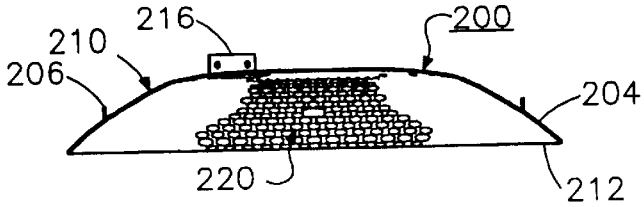
FIG. 4 is a side sectional view of the reflector collar for enhanced directional illumination control in accordance with the preferred embodiment taken along line A—A of FIG. 2.

Referring to FIG. 2, the down-light reflector collar 200 is designed with the predetermined contour 210 to enhance the directional control of the polymeric reflector/refractor 100. The overall contour 210 of the reflector collar 200 is defined or shaped from the intersection of a plurality of predetermined radii generally indicated by radii R1–R6, each having its center respectively indicated by P1–P6 offset from the vertical axis V of the polymeric prismatic reflector lamp source 110, and each rotated horizontally about the centerline of the vertical axis of the polymeric prismatic reflector/refractor 100 to generate the down-light reflector collar contour 210.

In accordance with features of the invention, additional optical control of reflector collar 200 to narrow the distribution of the polymeric prismatic reflector/refractor 100 using either clear enveloped lamps or phosphor coated lamps 110 is simply and effectively achieved by the use of multiple concave reflector impressions 220 selectively formed into the contour 210 of the reflector collar 200. These impressions 220 have been implemented with the shape of predetermined segments of a sphere, but it should be understood that impressions 220 are not limited to these shapes. The concave reflector impressions 220 creating overlapping reflected distributions of reflected illumination to fill in and smooth a bat-wing distribution photometric distribution produced by the polymeric prismatic reflector to create a bell curve distribution, filling in the 0–40 degree zonal efficiency of the photometric distribution.

The concave reflector impressions 220 are formed, for example, on a core of a hydroforming die by an EDM process leaving raised convex segments of a sphere on the core surface and these forms are pressed into the reflector contour at a predetermined size and depth. Each raised segment of a sphere standing above the reflector core form, produces an impression 220 of a concave reflector, and the core form of a hydroforming die is selectively covered with these raised segments of a sphere to produce multiple concave reflectors of defined shape and depth relative to the reflector collar contour which in turn provide the desired distribution with reflector collar 200. Each embossed impression 220 is designed to increase the efficiency in the 0–40 degree zone of the photometric light distribution of the optical assembly with little loss in efficiency or optical control of the prismatic polymeric reflector/refractor 100.

The primary shape 210 of the down-light reflector collar 200 includes, for example, six separate intersecting radii R1–R6, each having a position P1 offset from the predetermined centerline axis of the HID source. Each position of these radii is rotated about the predetermined centerline axis of the HID source to form the base line contour 210 of the reflector collar 200. Into five of the six radii segments a series of the small concave reflectors 220 are formed as negative segments of a sphere that are calculated for position and depth of spread to later be impressed into the contour 210 during the manufacturing process. Each series of these impressions 220 are designed as small concave reflectors in the final stage of the manufactured reflector collar 200 to redirect light from the lamp 110 in a direction passing close to the envelop of the lamp but not back through the arc tube of the HID lamp. Computerized raytracing advantageously is used to establish the spread of each spherical segment impression 220 and its respective location on the collar surface, as well as the pattern density of spherical segment impressions 220 on the contour of the reflector collar 200.

Figure 3:
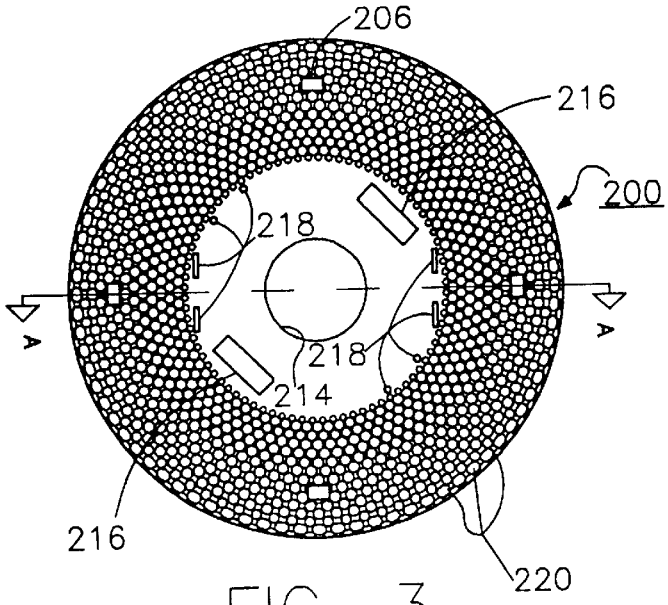
FIG. 3 is a bottom elevational view of the collar of FIG. 2 in accordance with the preferred embodiment.
Figure 6:
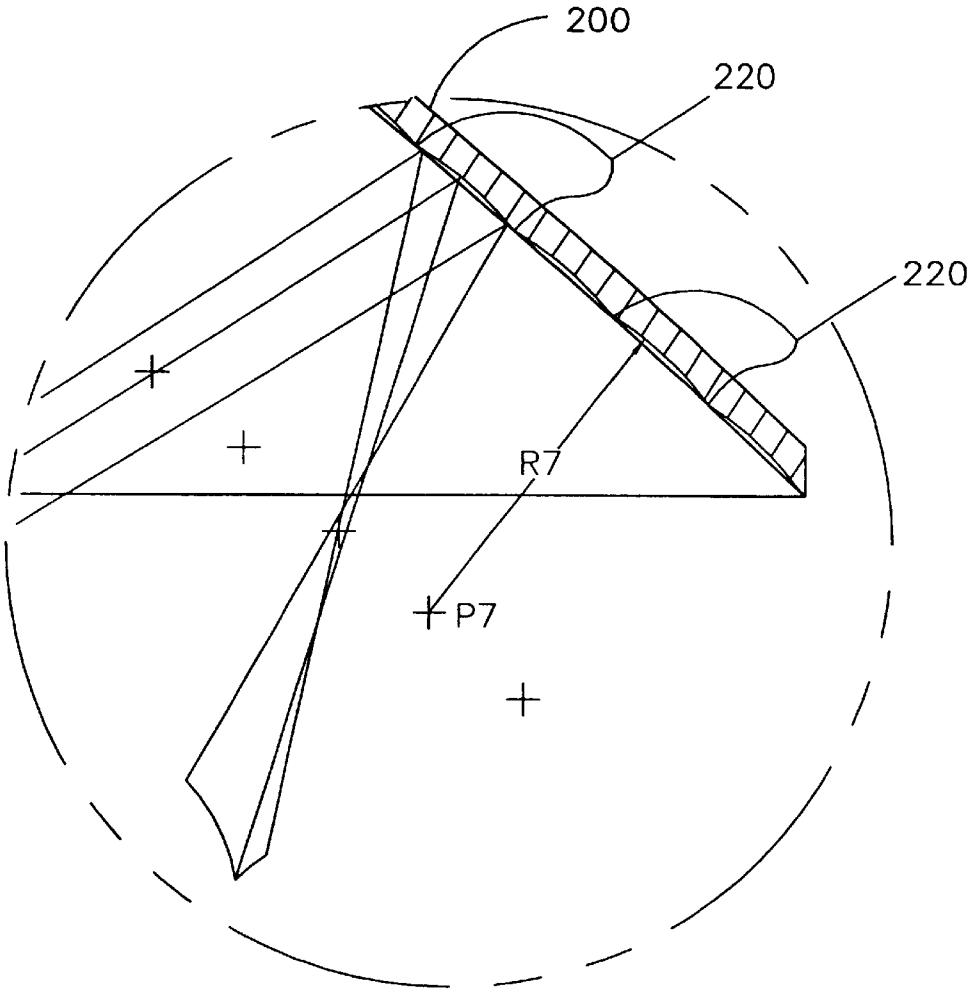
FIG. 6 is an enlarged fragmentary view of the collar of FIG. 2 illustrating multiple concave reflector impressions selectively formed into the reflector collar contour.

As best seen in FIGS. 3 and 6, each impression 220 in the reflector collar contour 210 is comprised of a negative segment of a sphere but could be other calculated shapes. Each series of negative impressions 220 provides controlled spread of the light from the lamp 110 at predetermined intervals complementing the distribution from the primary polymeric prismatic reflector/refractor 100 into the 0–40 degree zonal lumen quadrant. The series of the small concave reflector impressions 220 are designed to provide gradually decreasing spread and intensity of the reflected illumination from the concave impressions 220 approaching the lower edge 212 with the lowest spread and intensity of the reflected illumination from the concave impressions 220 on the lower portion 204 that supports the polymeric prismatic reflector/refractor 100. The series of the small concave reflector impressions 220 having radii, such as R7 from a center point P7 as shown in FIG. 6, that generally follow the reflector collar contour 210. Each impression 220 is defined by a raised surface on the spinning chuck or on the surface of a hydroforming core. For example, each shape forming respective reflector impressions 220 is first machined into the surface of an EDM electrode and this electrode then is used to electrically machine and form each raised shape on a steel core. This raised shape is compressed into the wall thickness of the aluminum down-light collar contour 210 during the reflector collar forming process. Each of the negative impressions 220 is compressed into the aluminum collar curvature at predetermined intervals in the collar material, with each individual impression 220 having a predetermined prescribed depth and curvature.

Figure 7A:
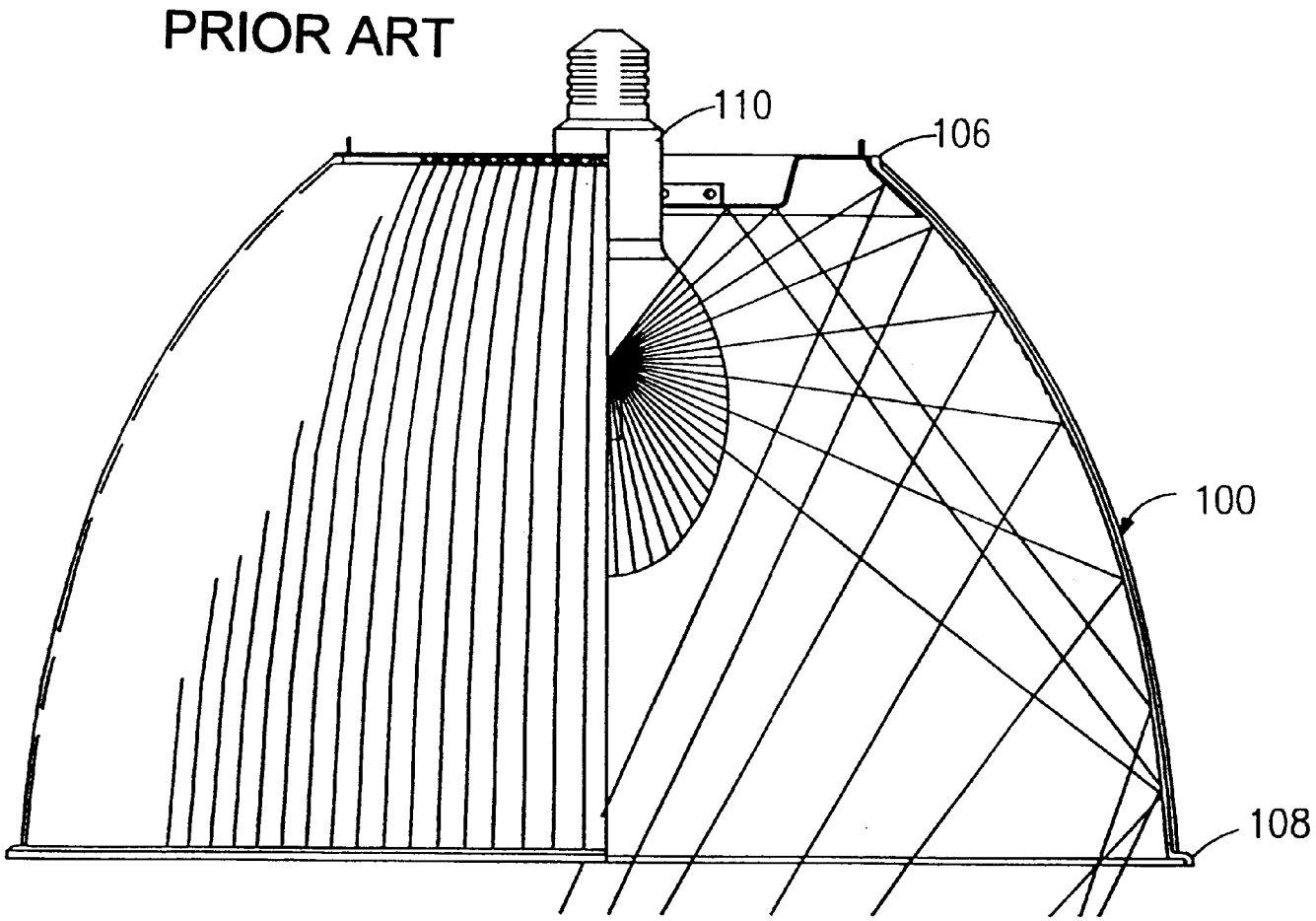
FIGS. 7A, 8A and 9A respectively illustrate light ray traces with the prior art prismatic reflector/refractor device of FIGS. 1A and 1B from the top, middle and bottom of a light source.
Figure 7B:
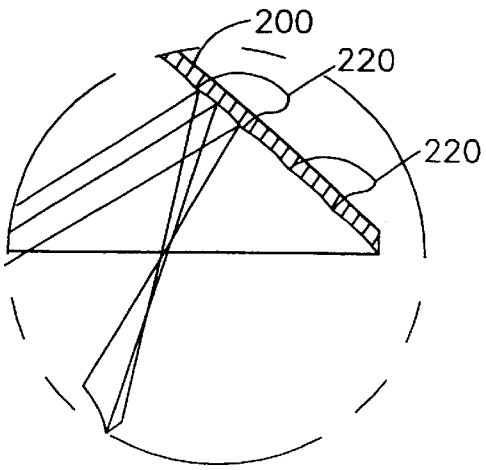
FIGS. 7B, 8B and 9B respectively illustrate light ray traces of the reflector collar in accordance with the preferred embodiment from the top, middle and bottom of a light source.
Figure 7B:
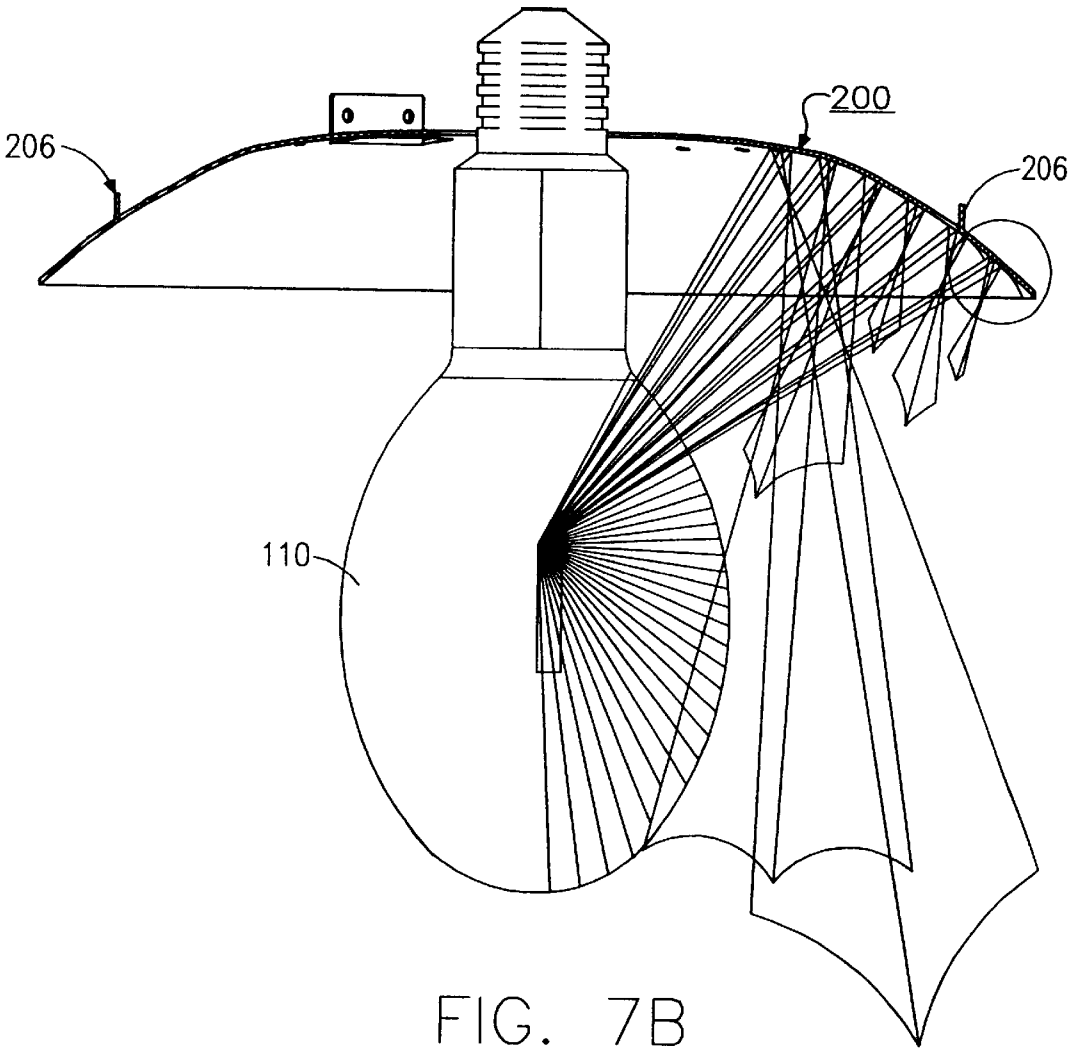
Figure 7C:
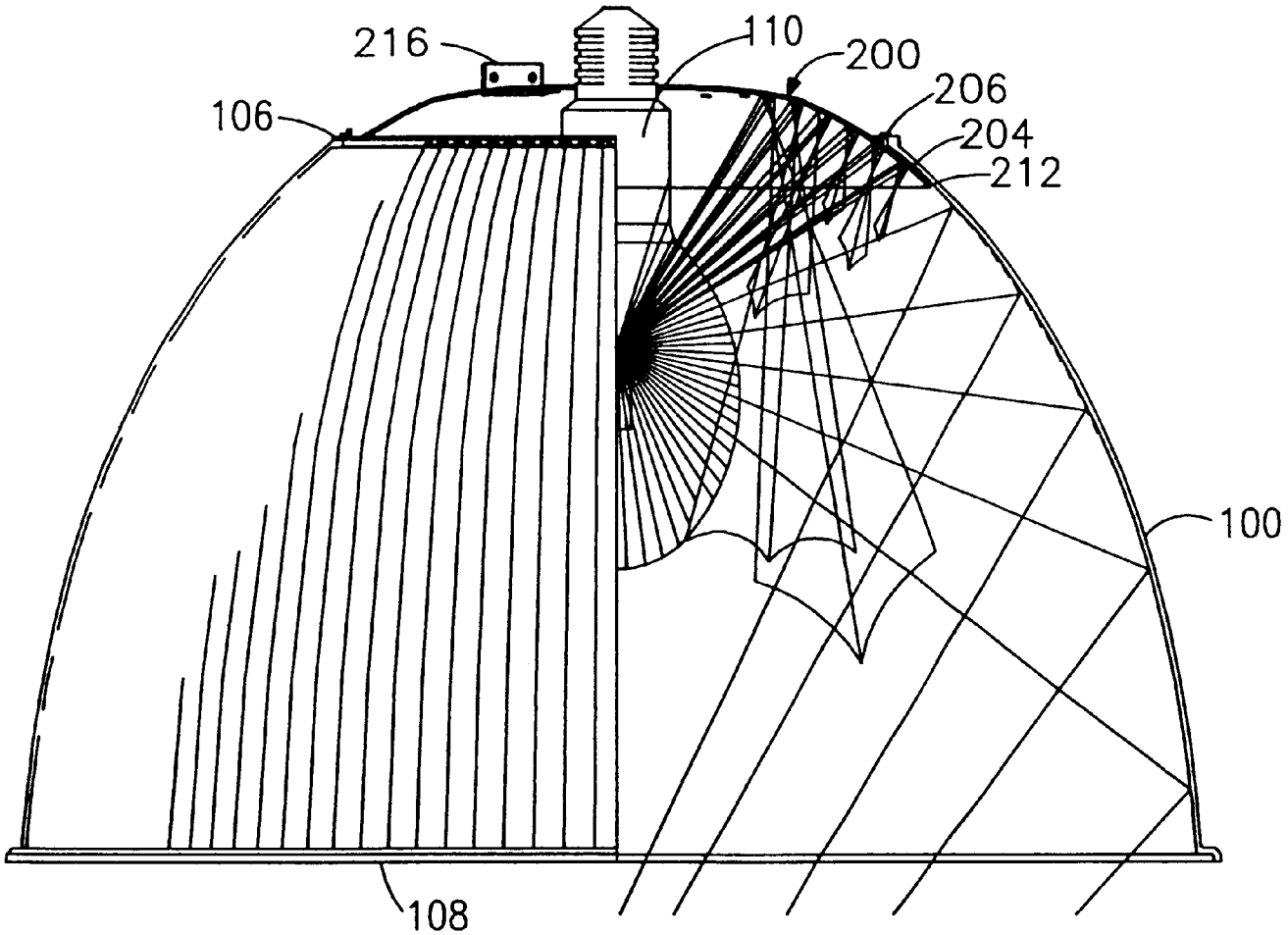
FIGS. 7C, 8C and 9C respectively illustrate light ray traces of the optical assembly of FIG. 2 including the prismatic reflector/refractor device of FIGS. 1A and 1B together with the collar for enhanced directional illumination control in accordance with the preferred embodiment.
Figure 8A:
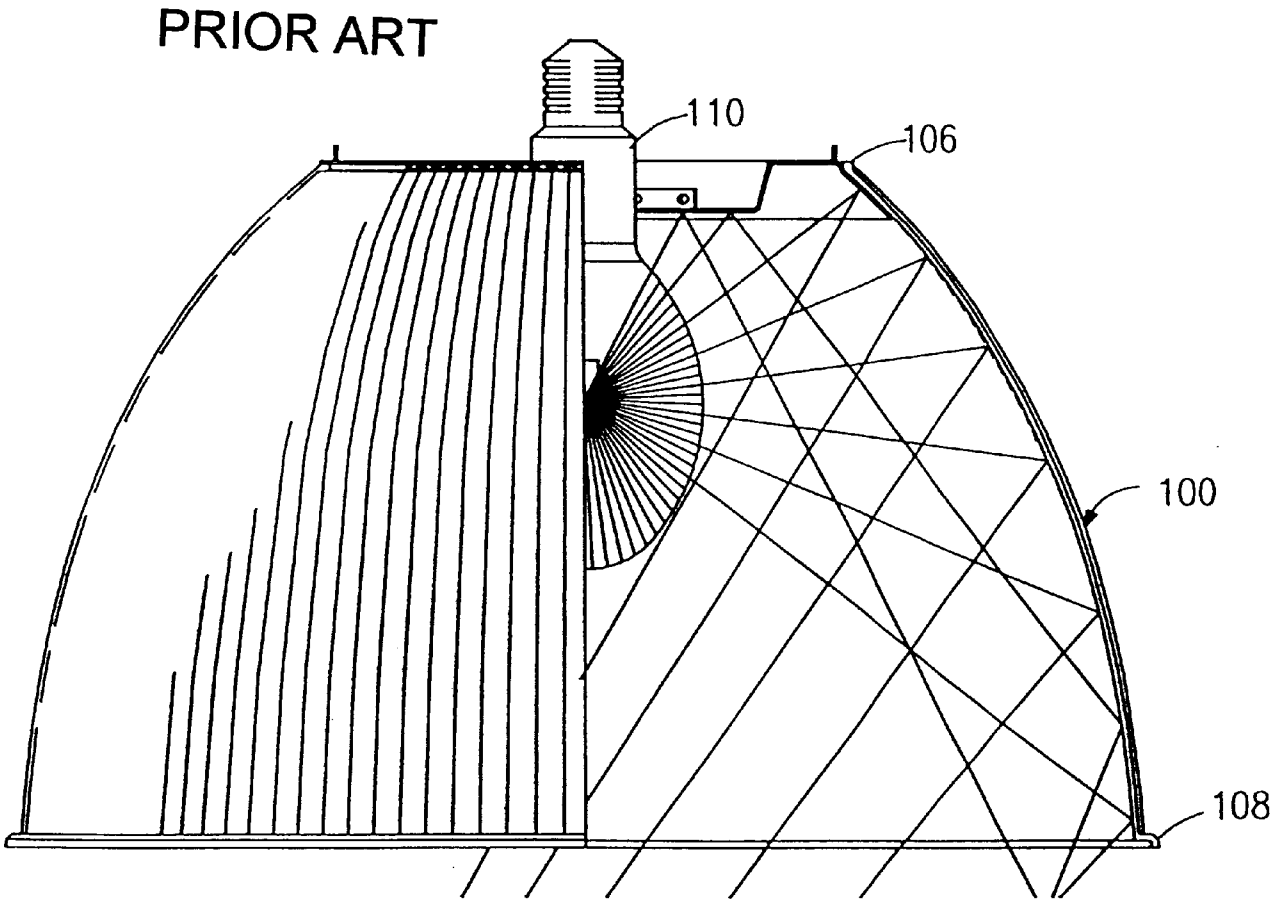
Figure 8B:
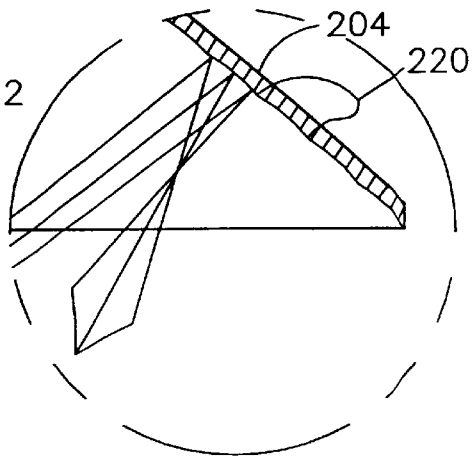
Figure 8B:
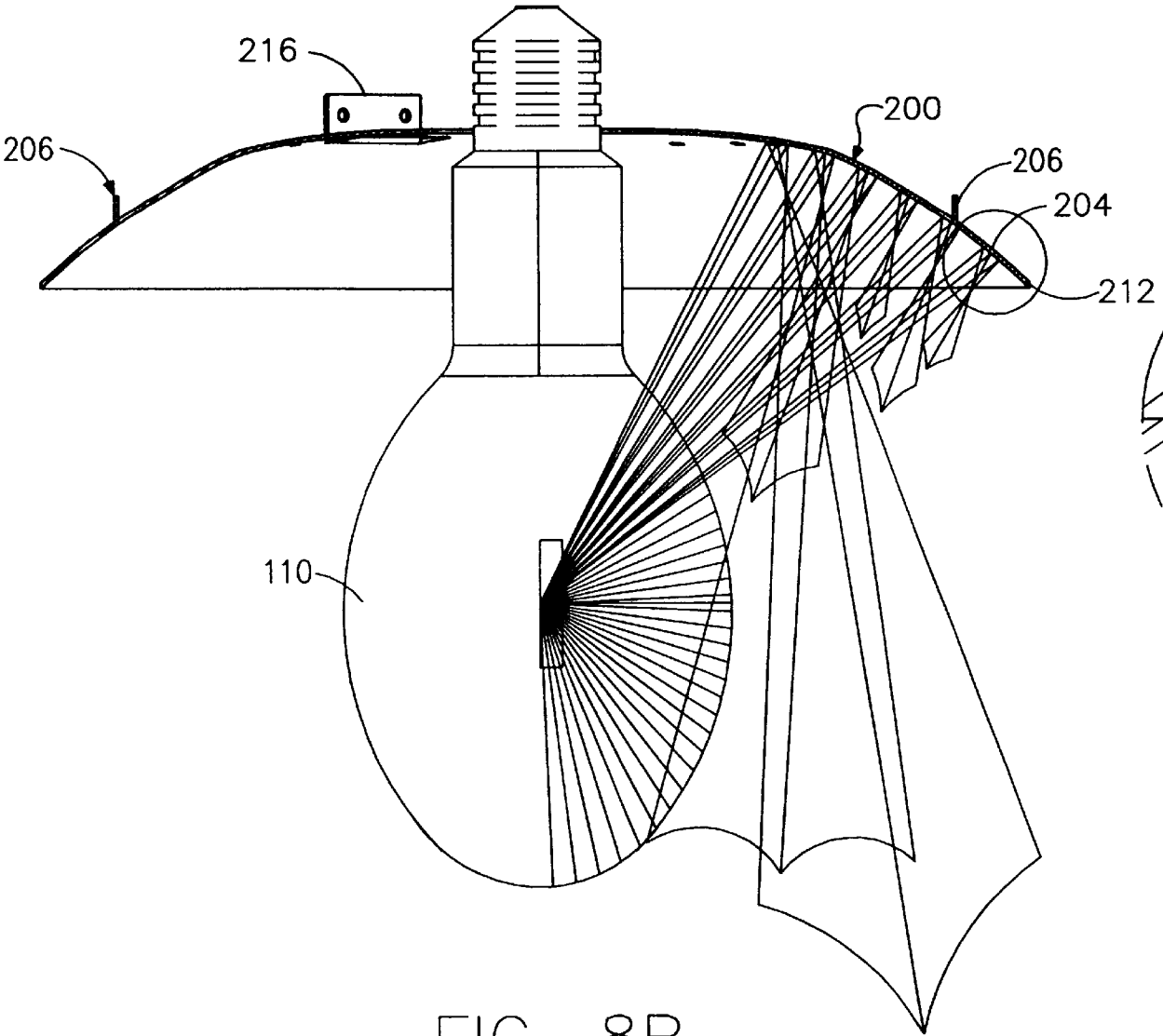
Figure 8C:
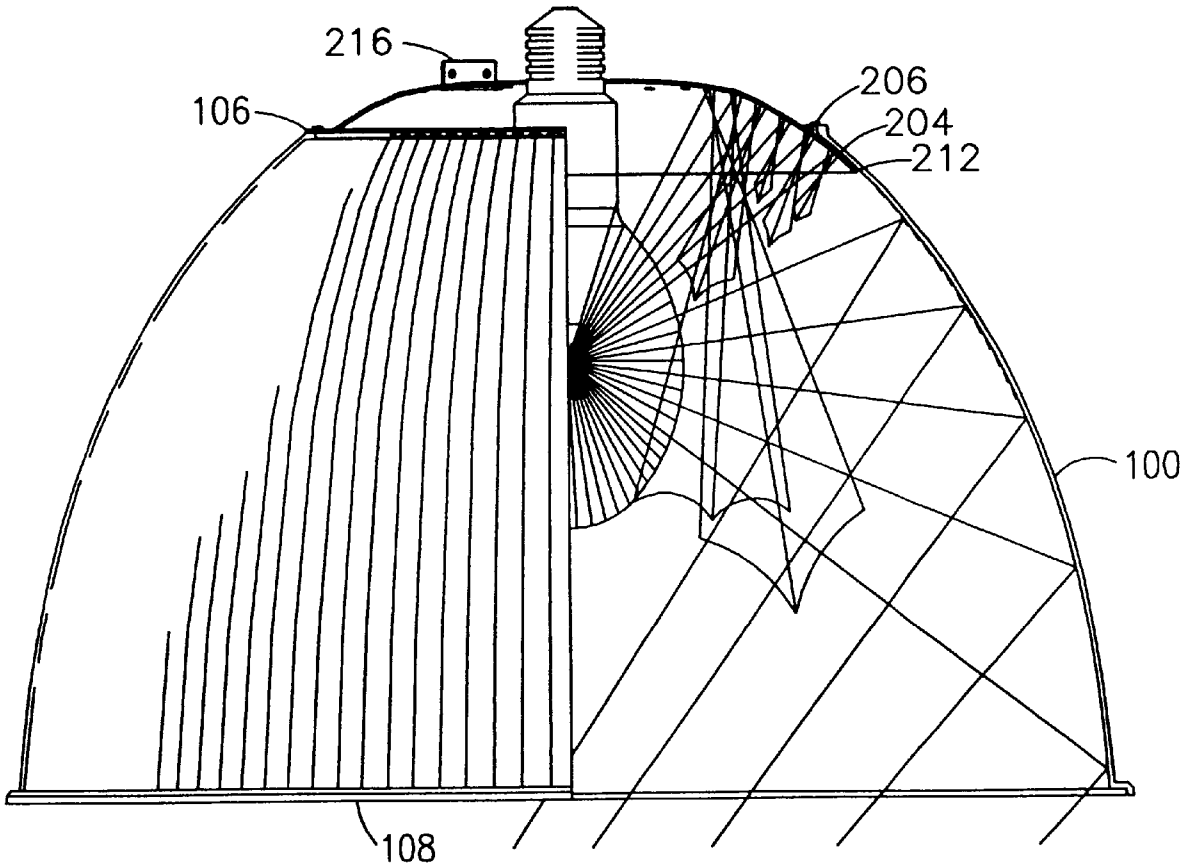
Figure 9A:
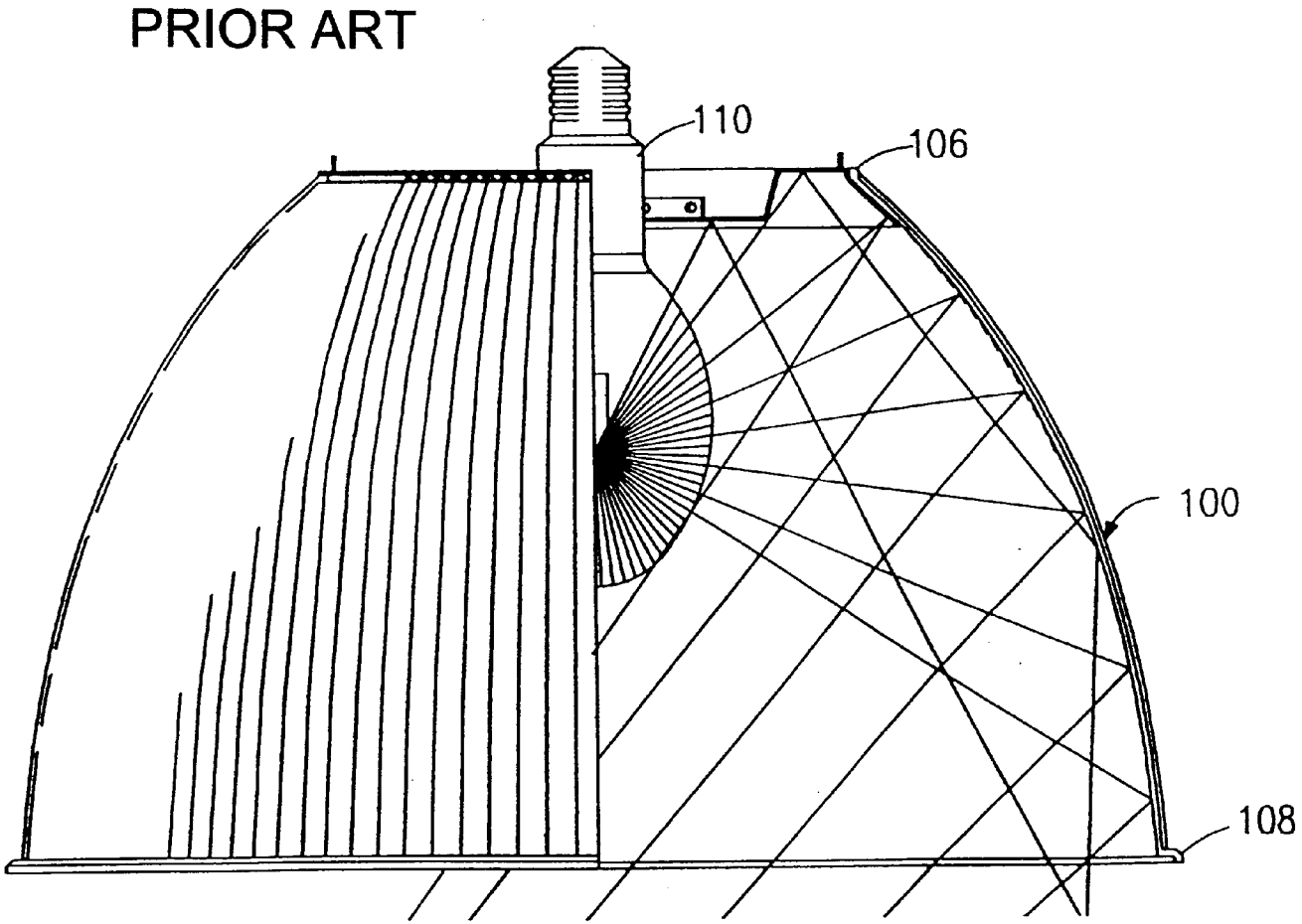
Figure 9B:
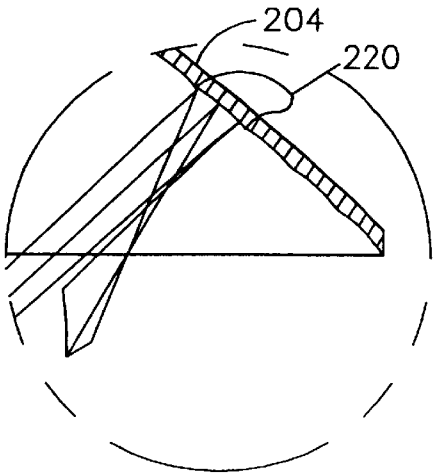
Figure 9B:
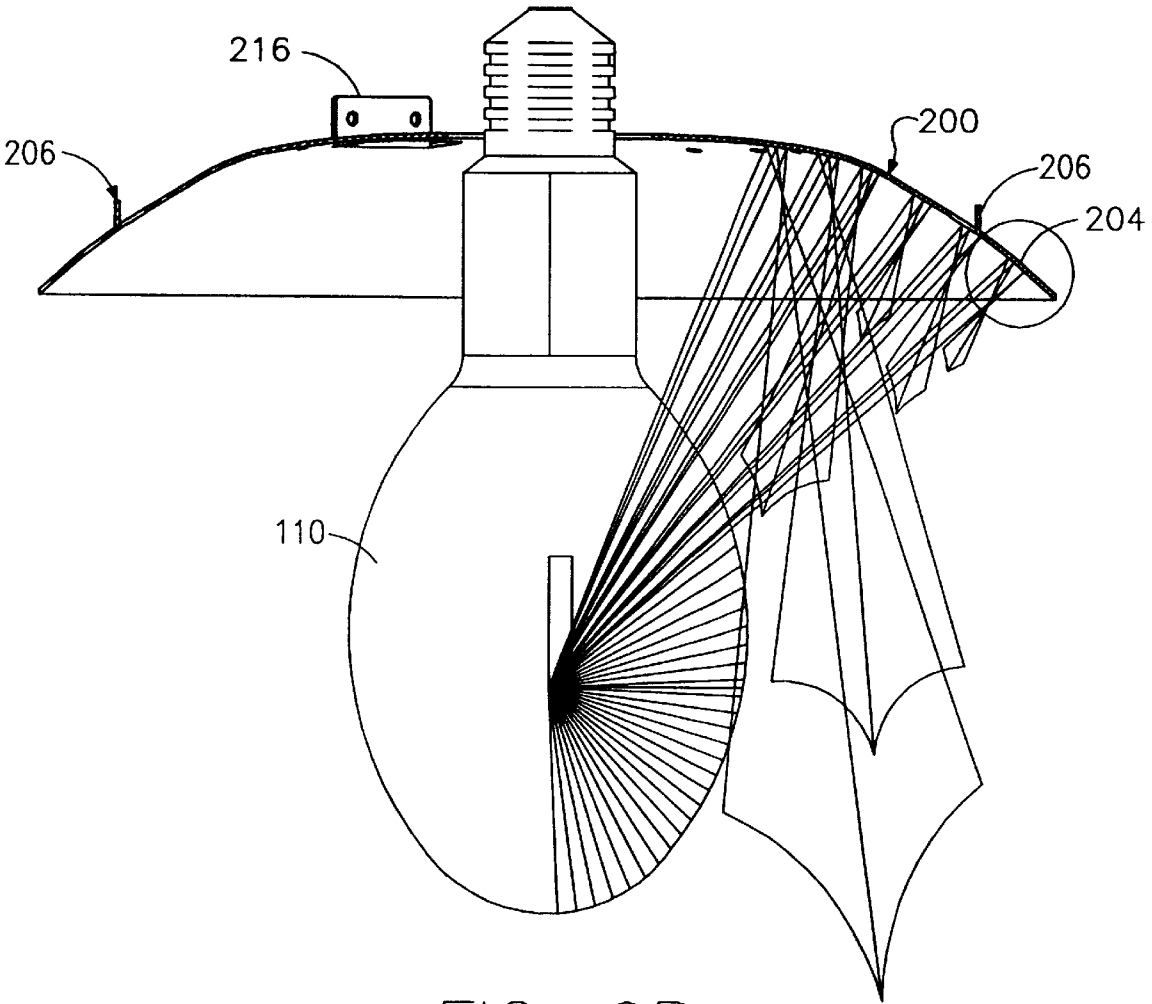
Figure 9C:
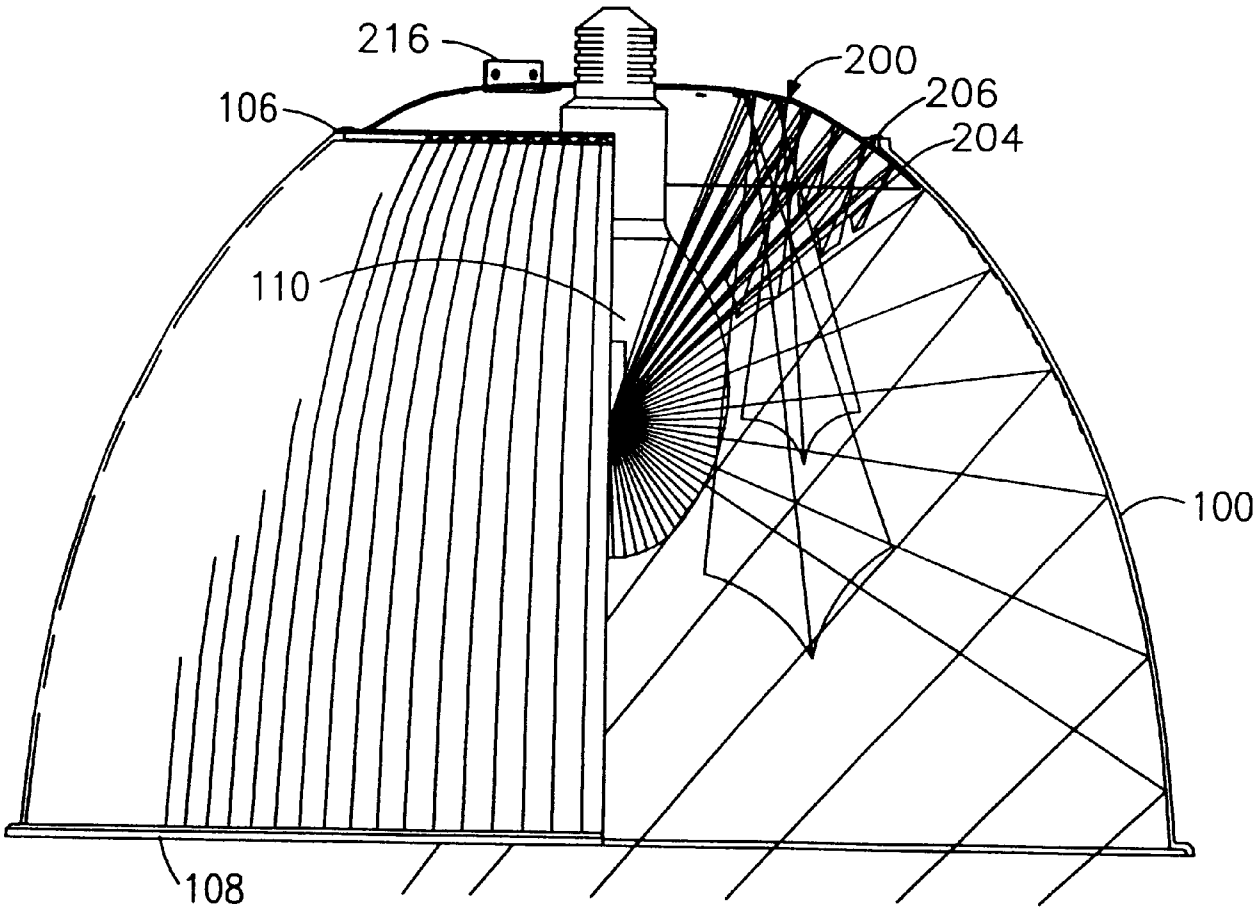

FIGS. 7A, 8A and 9A respectively illustrate light ray traces with the prior art prismatic reflector/refractor device 100 and a prior art collar from the top, middle and bottom of the light source 110 for comparison with function of optical assembly 202 including the reflector collar 200 of the preferred embodiment as shown in FIGS. 7C, 8C and 9C. The rays are traced at the top, midpoint and bottom of the HID lamp 110 on several positions along the vertical axis of the polymeric reflector contour 100 to create a desired pattern of the distribution and can be used for determining the necessary number and arrangement of the impressions 220 the reflector collar 200. For clarity the rays traces are not shown that pass through the area normally occupied by the lamp 110.

FIGS. 7B, 8B and 9B respectively illustrate light ray traces of the reflector collar 200 in accordance with the preferred embodiment from the top, middle and bottom of the light source 110. FIGS. 7B, 8B and 9B show the distribution of the rays as they are distributed through the lower opening 108 of the polymeric reflector, but without the detail of the polymeric reflector 110 for clarity. The light ray positions are again respectively shown starting at the top, midpoint and then the bottom of the HID arc tube 110 at a predetermined lamp center within the polymeric prismatic reflector. Note that the reflected path of the rays are directed away from the lamp envelope and toward the lower opening 108 of the polymeric reflector/refractor 100. As shown in these ray traces of FIGS. 7B, 8B and 9B, the distribution of the reflector collar 200 is not parabolic in shape or distribution. The contributions to the lower 0–40 degree zonal efficiencies of a photometric distribution are selective. Reflector collar 200 provides maximum spread and intensity of the reflected illumination from the concave reflector impressions 220 near the upper opening 206 with gradually decreasing spread and intensity of the reflected illumination approaching the lower reflector collar portion 204 supporting the polymeric prismatic reflector/refractor 100.

FIGS. 7BB, 8BB and 9BB respectively illustrate light ray traces from an illustrated enlarged lower portion 204 of the reflector collar 200 in accordance with the preferred embodiment from the top, middle and bottom of the light source 110. Multiple concave reflector impressions 220 are shown within the illustrated lower portion 204 of the reflector collar 200 that generally provide a lower spread and intensity of the reflected illumination from the reflector collar 200.

FIGS. 7C, 8C and 9C respectively illustrate light ray traces of the optical assembly of FIG. 2 including the prismatic reflector/refractor device 100 together with the reflector collar 200 for enhanced directional illumination control in accordance with the preferred embodiment. The effective function of the reflector collar 200 may be appreciated from a comparison of the ray traces for the optical assembly 202 shown in FIGS. 7C, 8C and 9C with the ray traces for the prior art prismatic reflector/refractor device 100 shown in FIGS. 7A, 8A and 9A.

While the present invention has been described with reference to the details of the embodiments of the invention shown in the drawing, these details are not intended to limit the scope of the invention as claimed in the appended claims.

What is claimed is:

1. An optical assembly enabling enhanced directional illumination control; said optical assembly comprising:

a reflector/refractor; said reflector/refractor having a predefined shape and being formed of a transparent material; and said reflector/refractor having a plurality of reflector/refractor prisms on an exterior body surface extending between an upper flange, opening and a lower flange, opening for reflecting and refracting light;

a light source disposed within said reflector/refractor substantially along a central vertical axis of said reflector/refractor;

a reflector collar supporting said reflector/refractor and for attaching said reflector/refractor to a luminaire ballast;

said reflector collar having a lower portion extending below said upper flange, opening of said reflector/refractor for positioning and supporting said reflector/refractor;

said reflector collar having a predetermined contour for generally forming an extension of an interior contour of said reflector/refractor; and a plurality of reflector impressions formed into said predetermined contour; said predetermined contour and said plurality of reflector impressions for providing directional illumination control for the optical assembly; and said plurality of reflector impressions being generally concave and facing said central vertical axis of said light source and being arranged at a predetermined density and at predetermined locations for controlled spreading of reflected light generally away from both said light source and a sidewall of said reflector/refractor and toward said lower opening of said reflector/refractor.

2. An optical assembly enabling enhanced directional illumination control; said optical assembly comprising:

a reflector/refractor; said reflector/refractor having a predefined shape and having a plurality of reflector/refractor prisms on an exterior body surface for reflecting and refracting light;

a light source disposed within said reflector/refractor substantially along a central vertical axis of said reflector/refractor;

a reflector collar supporting said reflector/refractor and for attaching said reflector/refractor to a luminaire ballast;

said reflector collar having a predetermined contour and a plurality of reflector impressions formed into said predetermined contour; said predetermined contour and said plurality of reflector impressions for providing directional illumination control for the optical assembly; and said reflector/refractor being supported by a lower portion of said reflector collar and said collar including a plurality of bendable tabs formed from said reflector collar contour and said plurality of bendable tabs bent over an upper flange of said reflector/refractor during assembly of the optical assembly for mounting said reflector/refractor in a fixed position.

3. An optical assembly enabling enhanced directional illumination control as recited in claim 2, wherein said reflector collar is formed of an aluminum material.

4. An optical assembly enabling enhanced directional illumination control as recited in claim 3 wherein an upper portion of said reflector collar includes an opening for receiving a lamp socket of said light source.

5. An optical assembly enabling enhanced directional illumination control as recited in claim 3 wherein said light source is disposed substantially along a central vertical axis of said reflector/refractor; and said predetermined contour of said reflector collar includes a plurality of predetermined radii, each having a center offset from said central vertical axis of said light source, and each rotated horizontally about said central vertical axis of said light source to define said reflector collar contour.

6. An optical assembly enabling enhanced directional illumination control as recited in claim 3 wherein each of said plurality of reflector impressions is formed as a segment of a sphere at a predetermined depth and a prescribed spread of diffusion from said light source.

7. An optical assembly enabling enhanced directional illumination control as recited in claim 3 wherein said plurality of reflector impressions formed into said predetermined contour include generally concave reflector impressions facing said central vertical axis of said light source.

8. An optical assembly enabling enhanced directional illumination control as recited in claim 6 wherein said plurality of generally concave reflector impressions facing said central vertical axis of said light source are arranged at a predetermined density and at predetermined locations to create a controlled spreading of reflected light away from said light source and a sidewall of said reflector/refractor.

9. An optical assembly enabling enhanced directional illumination control as recited in claim 3 wherein said predetermined contour and said plurality of reflector impressions for providing directional illumination control for the optical assembly create a controlled spreading of reflected light substantially in a 0–40 degree illumination distribution zone of the optical assembly.

10. An optical assembly enabling enhanced directional illumination control as recited in claim 3 wherein said plurality of reflector impressions creating overlapping reflected distributions of reflected illumination in a predetermined zone to selectively increase a photometric distribution produced by said reflector/refractor in said predetermined zone.

11. A reflector collar for directional illumination control used in combination with a reflector/refractor for reflecting and refracting light and a light source in an optical assembly; said light source disposed within said reflector/refractor substantially along a central vertical axis of said reflector/refractor; said reflector collar comprising:

a light reflecting member supporting said reflector/refractor and for attaching said reflector/refractor to a luminaire ballast; and said light reflecting member having a predetermined contour and a plurality of reflector impressions formed into said predetermined contour; said predetermined contour and said plurality of reflector impressions for providing directional illumination control for the optical assembly; and said light reflecting member including a plurality of bendable tabs formed from predetermined contour and said plurality of bendable tabs bent over an upper flange of said reflector/refractor during assembly of the optical assembly for mounting said reflector/refractor in a fixed position.

12. A reflector collar for directional illumination control as recited in claim 11 wherein said light reflecting member is formed of an aluminum material.

13. A reflector collar for directional illumination control as recited in claim 11 wherein said plurality of reflector impressions formed into said predetermined contour include generally concave reflector impressions facing said central vertical axis of said light source.

14. A reflector collar for directional illumination control as recited in claim 11 wherein each of said plurality of reflector impressions is formed as a segment of a sphere at a predetermined depth and a prescribed spread of diffusion from said light source.

15. A reflector collar for directional illumination control as recited in claim 11 wherein said plurality of reflector impressions formed into said predetermined contour are arranged at a predetermined density and at predetermined locations to create a controlled spreading of reflected light away from said light source and a sidewall of said reflector/refractor.

16. A reflector collar for directional illumination control as recited in claim 11 wherein said predetermined contour and said plurality of reflector impressions for providing directional illumination control for the optical assembly create a controlled spreading of reflected light substantially in a 0–40 degree illumination distribution zone of the optical assembly.

17. A reflector collar for directional illumination control as recited in claim 11 wherein said predetermined contour of said light reflecting member includes a plurality of predetermined radii, each having a center offset from said central vertical axis of said light source, and each rotated horizontally about said central vertical axis of said light source to define said predetermined contour.

18. A reflector collar for directional illumination control as recited in claim 11 wherein each of said plurality of reflector impressions is formed as a concave reflector impression relative to said central vertical axis of said light source; each said concave reflector impression having a predetermined depth.

19. A reflector collar for directional illumination control as recited in claim 18 wherein each said concave reflector impression has a predetermined size.

* * * * *